US005271563A

United States Patent [19]

Cerny et al.

[11] Patent Number: 5,271,563

[45] Date of Patent: Dec. 21, 1993

[54] FUEL INJECTOR WITH A NARROW ANNULAR SPACE FUEL CHAMBER

[75] Inventors: Mark S. Cerny, Sterling Hgts.; James F. Prestel, Rochester; Joseph F. Goulart, Union Lake, all of Mich.

[73] Assignee: Chrysler Corporation, Highland Park, Mich.

[21] Appl. No.: 993,203

[22] Filed: Dec. 18, 1992

[51] Int. Cl.[5] ..... F02M 51/06; B05B 1/34

[52] U.S. Cl. ..... 239/463

[58] Field of Search ..... 239/463, 533.11, 533.12, 239/585.1, 585.4, 585.5, 584, 900; 251/129.15

[56] References Cited

U.S. PATENT DOCUMENTS

| | | | |
|---|---|---|---|
| 1,252,254 | 1/1918 | Fisher . | |
| 4,292,947 | 10/1981 | Tanasawa et al. | 239/585.5 X |
| 4,869,429 | 9/1989 | Brooks et al. | 239/585.4 X |
| 4,877,187 | 10/1989 | Daly | 239/585.4 X |
| 4,971,254 | 11/1990 | Daly et al. | 239/900 X |
| 5,170,945 | 12/1992 | Daly et al. | 239/585.4 |
| 5,207,384 | 5/1993 | Horsting | 239/463 |

FOREIGN PATENT DOCUMENTS

| | | | |
|---|---|---|---|
| 2241973 | 9/1990 | Japan | 239/900 |

*Primary Examiner*—Andres Kashnikow
*Assistant Examiner*—William Grant
*Attorney, Agent, or Firm*—Kenneth H. MacLean

[57] ABSTRACT

An improved fuel injector for an internal combustion engine generating very fine atomization of fuel even at the initiation of a valve opening event and including a cylindrical valve element terminating in a semi-spherical end portion which engages a valve seat to close the injector. The fuel quantity is controlled by maintaining the valve in an opened operative positions for a predetermined variable period of time. Fuel atomization in the form of very small particles is generated by providing an annular chamber upstream of the valve seat, this annular chamber being very narrow and short as to form an insignificant volume of fuel even when the valve is closed and the fuel motionless.

4 Claims, 2 Drawing Sheets

FUEL INJECTOR WITH A NARROW ANNULAR SPACE FUEL CHAMBER

BACKGROUND OF THE INVENTION

1. Field of the Invention

This application concerns an improved fuel injector for an internal combustion engine with superior fuel preparation characterized by very fine atomization of the fuel. Introduction to the engine of very small fuel particles promotes good fuel economy and reduced exhaust emissions. Poor fuel preparation or atomization is a common problem with prior fuel injectors and the atomization quality is particularly poor upon opening of the injector's valve. The subject injector produces fine fuel atomization throughout the entire valve opening/-closing event.

2. Description of Related Art

In fuel injection design, an objective is good fuel preparation with production of a spray consisting of fine fuel particles. Prior injector designs have been found to be incapable of consistently generating a spray with such small fuel particles over the entire opening/-closing valve event and especially when the valve first opens. Particularly when the valve in these prior injectors is first opened, it has been found that the particle size is relatively large. The subject injector has achieved good fuel atomization, that is, particle size of ten microns or less even when the valve first opens.

It has been recognized previously that good fuel preparation or atomization is desirable particularly at the beginning of the injector valve's opening. An early example of injector design theory is found in the U.S. Pat. No. 1,252,254 to Fisher disclosing a mechanically controlled fuel control device as opposed to the subject electrically controlled fuel injector. The Fisher design provides for a constant flow through the device even when the valve is closed. The aim is to improve fuel preparation particularly as the valve first begins to open. In Fisher, the valve movement from a closed position to a more opened position is by a lever which is actuated by an undisclosed device associated with operation of the engine, probably a cam.

The Fisher patent teaches us that by maintaining continuous fuel movement, fuel atomization is improved. It is known that a still liquid which is suddenly acelerated by, for example, a Valve opening, will not be initially finely atomizied. As previously mentioned, fuel in the Fisher device constantly flows through an annular chamber upstream of the valve. Then when the valve is opened, the already moving fuel passes to the outlet and is discharged from the injector in a fine spray. Even when the Fisher valve is closed, fuel is passed through the annular chamber and is routed back to the fuel tank through a groove and several passages formed in the valve. Without the above described continuous flow through the Fisher device, a significant quantity of stagnant fuel would accumulate above the outlet when the valve is closed. Subsequently, when the valve opened, a relatively large volume of fuel would decend in a mostly axial direction to the outlet and be discharged in the form of relatively large droplets.

Thus we see that to achieve good atomization of fuel in the Fisher device, a contant flow of fuel is made to pass therethrough. When the valve is opened, the fuel is discharged from the outlet of the device. However when the valve is closed, the flow must have an alternative route. This route is through a groove and passages formed in the valve. This alternative route must be blocked when the valve is open in order to maintain fluid pressure in the device. Accordingly, the groove is so located that upward movement of the valve causes a sleeve to cover the groove effectively severing the alternate route. This arrangement of the groove and sleeve and their spacing would be very critical and difficult to achieve particularly in a high pressure device. Therefore, such an arrangement in the subject device would be unwelcome and perhaps unworkable due to the required precise axial locating of the groove relative to the sleeve as well as close tolerances between the members. The required return tubing and so forth is also undesirable.

The subject fuel injector is electrically actuated and electronically controlled. It is a pulse width modulated type in which a valve moves from a normal closed position to an opened position in response to energization of a coil of an electric solenoid. The quantity of delivered fuel is determined by the length of time the coil is energized. This length of time which the coil is energized is determined by action of an electronic control unit or computer which responds to several engine and vehicle parameters or input signals. A primary objective of the subject electronically controlled injector is superior fuel preparation, namely fuel atomization characterized by very fine particles right from the opening of the injector valve through valve closure. This has been achieved by production of a spray pattern with fuel paricles with an average particle size of ten microns or less right from the initiation of valve opening to the closing of the valve.

SUMMARY OF THE INVENTION

The subject fuel injector is a pulse width modulated type injector especially useful for supplying fuel to a single cylinder as in a multi-point fuel injector system now available on several Chrysler Corporation engines. The injector has a very narrow and low volume annular chamber located upstream of the valve seating surface. Multiple inlets are situated to direct fuel tangentially into the chamber so that fuel entering the chamber has a predominately radial velocity and thus will swirl about the central portion of the injector valve. This radial velocity is important to produce excellent fuel atomization characterized by a very small average particle size.

Unlike the Fisher fuel control device, the subject injector does not use a return fuel path or return lines. Consequently, the flow is interrupted by closure of the injector valve and there is not a ceaseless flow a in the Fisher device. Consequently, there is no need for the precisely positioned flow blockage structure of Fisher. The very narrow and low volume annular chamber formed about the injector valve in the subject injector replaces the relatively large volume Fisher chamber. The resultant low volume chamber holds only a very small volume of still fuel prior to valve opening. As a result, there is no significant quantity of motionless fuel above the closed valve to be discharged in large droplets.

By way of example, the preferred embodiment of the fuel injector as illustrated is for an associated combustion chamber of about 0.5 liters. The outer diameter of the narrow chamber is 2 mm and the inner diameter as defined by the valve's end portion is 1.8 mm. Thus, the width of the annular space or narrow chamber is only 0.1 mm. Further, its height dimension above the valve seat surface is only about 1 mm. Therefore, the chamber's volume is only about 0.6 cubic mm. Testing of the fuel injector with these characteristics prove that the 0.6 cubic mm chamber holds an insignificant volume of motionless fuel which does not contribute to poor atomization of the fuel spray. In these tests, an average particle size of 10 microns or less at 1000 psi fuel pressure was consistantly generated.

It has been discovered and demonstated that poor fuel atomization is most critical when the engine is idled. During idle, the ratio of motionless fuel volume to total injected fuel volume is at a maximum. This is because the valve is held open the shortest period of time under the idle condition and thus the initial valve opening portion of the injection is most critical. At idle, this maximum volume ratio is less than 20 percent. This low ratio permits the injector to produce excellent overal fuel preparation with a very small average fuel particle size.

Further advantages of the subject fuel injector will be more readily apparent from a reading of the following detailed description of a preferred embodiment which is illustrated in the accompanying drawings as described below.

IN THE DRAWINGS

FIG. 1 is an elevational view of the subject fuel injector mounted in a cylinder head of a combustion chamber of a two cycle type internal combustion engine; and FIG. 2 is an enlarged elevational and sectioned view of the subject injector in the cylinder head; and FIG. 3 is a greatly enlarged elevational and sectioned view of the lower outlet portion of the subject injector shown in its closed operative condition taken along section line 3—3 in FIG. 5 and looking in the direction of the arrows; and FIG. 4 is a view similar to FIG. 3 but with the valve element withdrawn to better show the space above the valve seating surface and taken along section line 4—4 in FIG. 5 looking in the direction of the arrows; and FIG. 5 is a planar and fragmentary sectioned view of the subject injector taken along section line 5—5 in FIG. 4 and looking in the direction of the arrows.

DETAILED DESCRIPTION OF A PREFERRED EMBODIMENT

Figure 1:
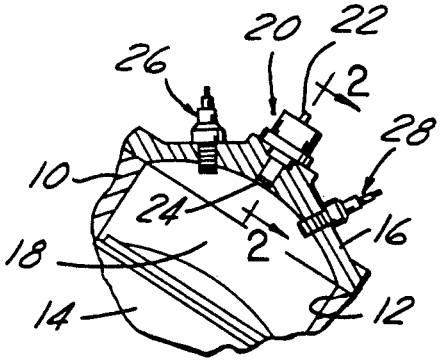

In FIG. 1, a portion of an engine block 10 is shown which has a cylinder bore 12 extending therein. An upper portion of a piston 14 is supported in the cylinder bore 12. A cylinder head 16 lies adjacent engine block 10 and overlies bore 12 to define a variable volume combustion chamber 18.

The subject fuel injector 20 is mounted in cylinder head 16. Injector 20 has electrical contacts 22 (only one is visible) positioned externally at one end of the injector. The injector's opposite interior end 24 is exposed to the combustion chamber 18 and is adapted to selectively spray fuel directly into the combustion chamber 18.

A pair of spark plugs 26, 28 are mounted in the cylinder head 16. Electrical cables (not shown) direct high voltage electrical energy to the spark plugs at an appropriate time to create a spark in the combustion chamber 18 for igniting a fuel/air mixture therein.

Figure 2:
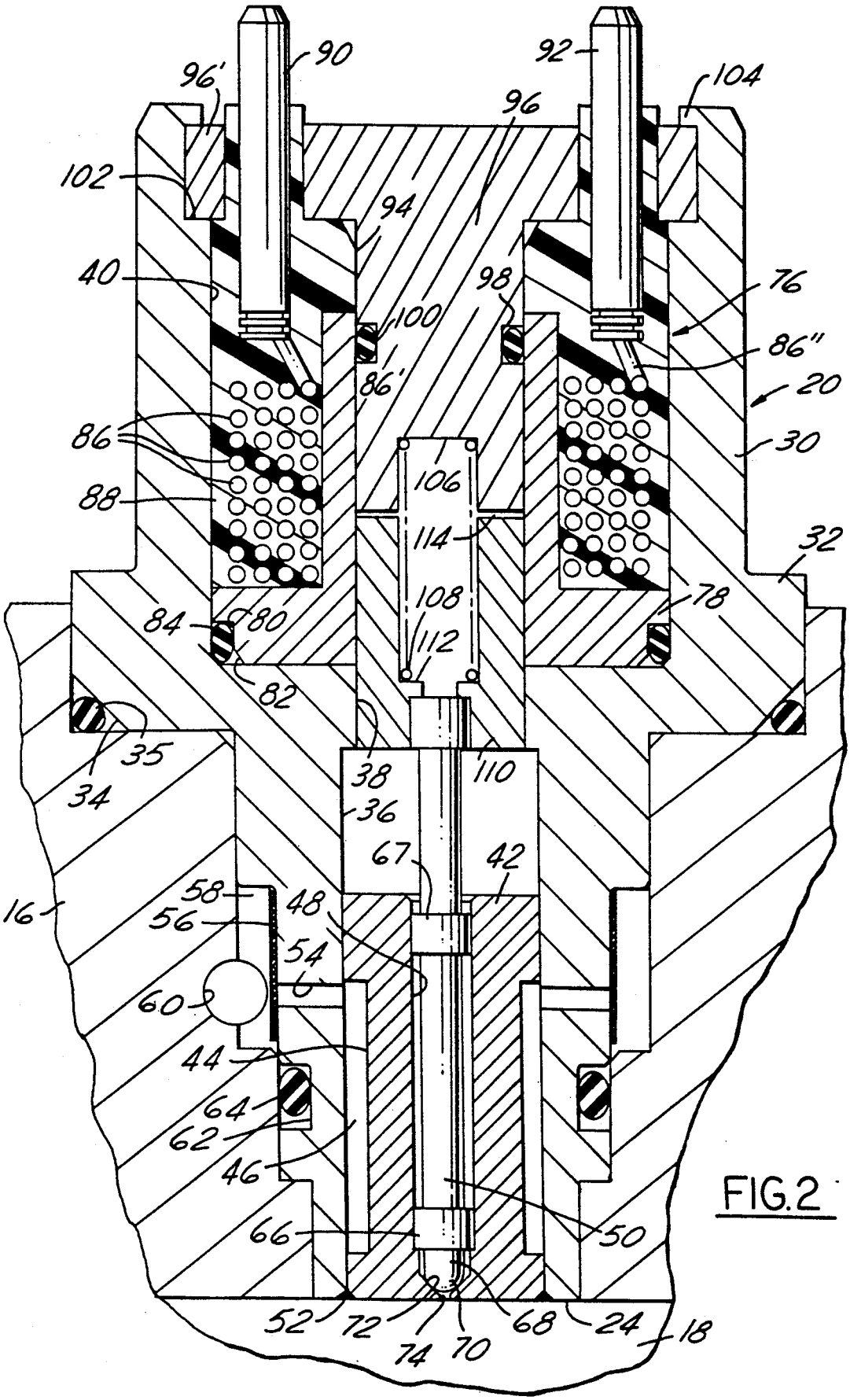

FIG. 2 illustrates details of the subject fuel injector 20 including a generally cylindrical housing 30 with a radially enlarged annular midportion 32. Portion 32 is received within an enlarged recess in the cylinder head 16 and has a beveled corner 34 which coacts with corner walls of the recess to form a cavity. An O-ring type seal 35 is captured in the cavity to seal housing 30 relative to the cylinder head 16.

Housing 30 has coaxial bores 36, 38 and 40 formed therein. Bore 36 which is adjacent interior end 24 supports a cylindrical valve guide member 42. A channel 44 is formed about the midportion of guide member 42 to define a chamber 46 in cooperation with the surrounding housing 30. A central bore 48 which extends partly through guide member 42 supports an elongated valve element 50. Valve 50 is free to reciprocate in bore 48. As a final assembly step of the injector, the valve guide 42 is permanently attached to housing 30 at its interior end portion 24 by a weld 52. The weld not only connects the members 30, 42 but also seals the joint therebetween.

Chamber 46 receives fuel through radial inlets 54 which extend through the housing 30. A mesh filter 56 is wrapped about housing 30 and over the ends of passages 54 to prevent foreign particles from entering the injector. Fuel passes to inlet 54 and chamber 46 from an outer annular chamber 58 which is formed between the housing 30 and the recess in the cylinder head 16. In turn, fuel passes to chamber 58 through a passage 60 extending through the cylinder head 16. A channel 62 is formed adjacent chamber 58 which supports an O-ring type seal 64 to prevent leakage.

In the illustrated embodiment, the valve element 50 has a pair of radially enlarged and axially spaced portions 66, 67 with outer dimensions closely sized relative to bore 48 to permit reciprocal movements of valve 50 but to inhibit leakage of fuel thereby. Alternatively, valve 50 can have a continuous diameter between portions 66 and 67. Adjacent portion 66, the lower end portion 68 of valve 50 is cylindrical and has a semispherically shaped end surface 70. When the valve element 50 is in its closed operative position, curved end surface 70 engages or seats against a conical seating surface 72 formed in guide member 42. Guide member 42 has a small outlet port 74 therein to direct a spray of fuel into combustion chamber 18 when the curved end 70 is lifted upwardly from seating surface 72.

As previously indicated, fuel flow is controlled by opening valve 50 its closed operative position for each combustion event. The time period for which the valve is opened is dependent upon the quantity of fuel needed by the particular engine operation. The valve is opened by an electromagnetic actuator which moves the valve 50 from the closed to the opened position. The actuator includes a coil assembly 76 including tubular bobbin member 78 which is molded of elastomeric material. The bobbin 78 is supported within bore 40 of housing 30 and has an edge or corner groove 80 which defines a seal cavity 82 to support O-ring 84 for sealing.

The electrical part of the assembly includes a coil of wire 86 which extends about the outer surface of the bobbin member 78 and is encapsulated in a molded cover element 88 of elastomeric material. The opposite ends 86' and 86" of the coil 86 are connected to a pair of electrical terminals 90, 92 respectively. The lower end portions of the terminals 90, 92 are covered by material 88 but the upper portions extend outward from the injector housing 30 for connection to electrical power and control leads (not shown).

The bobbin member 78 and cover member 88 together define a central bore 94 extending through the actuator assembly and is coaxial with and the same diameter as bore 38 in the injector housing 30. A stationary pole piece 96 has a central portion which is extends into bore 94. The central portion has a groove 98 formed thereabout for receiving an O-ring sealing member 100. The pole piece 96 also has a radially extending head portion 96' which seats against a shoulder 102 of housing 30. An upper edge 104 of housing 30 is mechanically deformed over the portion 96' of the actuator assembly to secure the actuator assembly to the housing 30.

The pole piece 96 has a central recess 106 formed in its central portion for receiving an upper end of a coil type spring 108. Supported below the pole piece 96 is an armature member 110 which is sized to permit reciprocal movement of the armature in bores 38 and 94. A recess 112 is formed in an upper portion of the armature 110 to receive the lower end of the coil spring 108. The armature 110 is attached to the upper end of valve 50 so they move as one in an axial direction defined by bores 38, 48 and 94. Specifically, they move upward in response to the magnetic force field procuced by energization of coil 86 and they move downward by the force of spring 108 upon deenergization of the coil In FIG. 2, the valve is shown in its downward, fully closed position. The small axial gap 114 between the pole piece 96 and armature 110 defines the maximum allowed upward lift or opening of the valve's end 70 from seating surface 72. The force of spring 108 returns the valve's end 70 against the seating surface 72.

Figure 3:
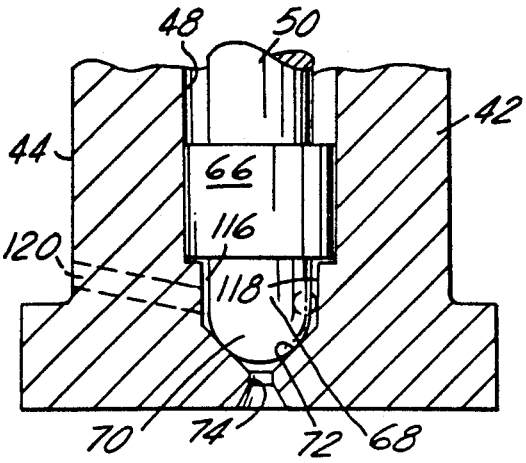

The lower end portion of the injector housing is enlarged in FIG. 3 and valve 50 is shown in its closed operative relative to the seating surface 72. It can be seen that the tolerance between the radially enlarged portion 66 and the bore 48 is very close to inhibit leakage of fuel therebetween while still allowing reciprocal movement of the valve element 50. An annular chamber 116 is formed between a bore 118 in member 42 and the cylindrical portion 68. The height of chamber 116 is defined between the contact of end 70 with surface 72 and portion 66 of valve 50. As previously described, the radial width of this space 116 is one-half the difference in the diameters of bore 118 and of cylindrical end 68. In the preferred working embodiment, this width is only 0.1 millimeters. The height of chamber 116 is only about one millimeter and thus the volume of chamber 116 is only about 0.6 cubic mm. In FIG. 3, the small volume of chamber 116 is obvious as compared to the total space defined by bore 118 without end portion 68 which about 3.1416 cubic mm. Thus the volume of chamber 116 is only about 19 percent of the greater space defined by bore 118.

Figure 4:
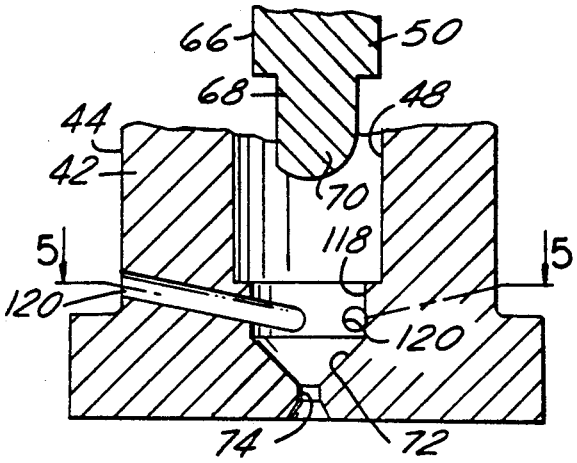
Figure 5:
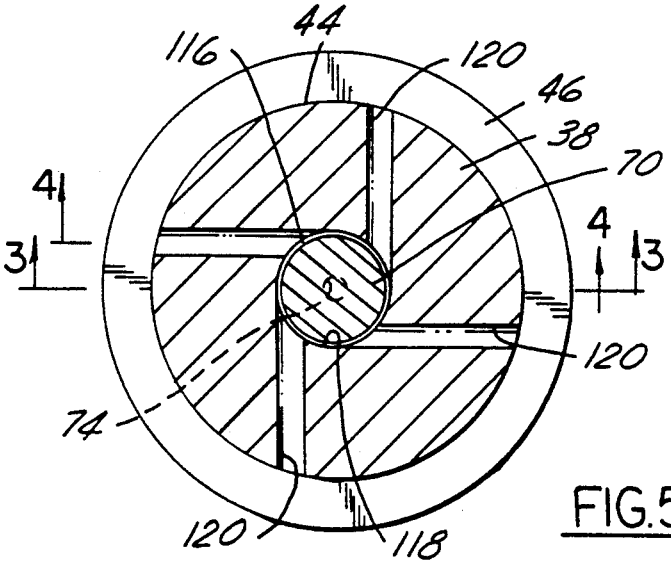

The view of FIG. 4 is similar to that of FIG. 3, but valve element 50 is withdrawn or raised upwardly out of bore 48 a sufficient distance to reveal the space formed by bore 118. This is to allow better viewing of the four fuel inlet passages 120. Note that the total distance that valve 50 is moved upwardly is much greater than the distance that small gap 114 would permit during operation of the fuel injector. Each inlet passage 120 has a small diameter of only about 0.4 millimeters so that fuel flows at high velocity into chamber 116 when the end 70 lifts from seat 72. As best shown in FIG. 5, the inlets 120 extend from chamber 46 through the outer surface 44 of guide member 42 and past the inner surface which forms bore 118 and into space 116. The inlet passages 120 are so oriented in guide member 42 so as to discharge fuel tangentially into narrow chamber 116. As a result, almost instantaneously after end 70 lifts from seat 72, fuel moves in a generally rotative or swirling direction and then is discharged from outlet port 74 into the associated combustion chamber. Tests confirm that this arrangement promotes a very fine atomization of fuel resulting in an average fuel particle size of about ten microns or less when the fuel pressure is about 1000 psi.

Although only one embodiment have been illustrated and described in detail, it should be understood that modifications are contemplated which fall within the scope of the invention as defined by the following claims.

WHAT IS CLAIMED IS AS FOLLOWS:

1. For an internal combustion engine, an improved fuel injector with a movable cylindrical valve element including a radially enlarged portion, said cylindrical valve element terminating in a semi-spherical end, the curved surface of which engages a seating surface to close the injector and block fuel flow and which moves from the seating surface to allow fuel to flow from the injector, said radially enlarged portion being spaced upstream from said semi-spherical end, fuel quantity being controlled by cycling the valve alternately between an opened and a closed condition at a desired variable rate, the improved injector characterized by fine atomization of fuel into very small particles even at the start of a valve opening event when there is motionless fuel upstream of the valve, the improvement comprising: a valve guide member having a radially inwardly stepped bore adapted to encircle the cylindrical valve element and semi-spherical end, such that the radially outward portion of said stepped bore surrounds said radially enlarged portion, and the radially inward portion of said stepped bore surrounds the portion of said valve element beneath said radially enlarged portion, the diameters of the radially inward portion of said stepped bore and of the portion of the cylindrical valve element between said radially enlarged portion and said semi-spherical end defining a narrow annular space therebetween to minimize a significant volume of motionless fuel upstream of the seating surface; at least one inlet through the guide member to introduce fuel into the annular space, the orientation of each of the inlets through the guide member directing fuel flow tangentially into the narrow annular space at high velocity as soon as the valve element lifts from the seating portion during initiation of injector openings, creating a rotating flow of fuel; and outlet means to direct the rotating flow of fuel from the annular space into an associated engine.

2. The improved fuel injector set forth in claim 1 in which the volume of the annular space is about nineteen percent of the volume defined by the radially inward portion of the stepped bore without the portion of the valve element beneath said radially enlarged portion, whereby at the initiation of a valve opening event, the quantity of still fuel in the annular space is not sufficient to cause formation of, large fuel particles while the high fuel velocity from each of the inlets rapidly generates rotative motion of fuel in the annular space which generates a desired fine atomization of fuel into very small particles.

3. The improved fuel injector set forth in claim 2 in which the narrow annular space has an outer diameter of about 2 millimeters, the cylindrical portion of the valve element beneath the radially enlarged portion has a diameter of about 1.8 millimeters and the annular chamber is about 1 millimeter high resulting in a volume for the annular space of about 0.6 cubic mm.

4. The improved fuel injector set forth in claim 1 for about a 0.5 liter combustion chamber of an engine in which the annular space has an outer diameter of about 2 millimeters, the cylindrical portion beneath said radially enlarged portion has a diameter of about 1.8 millimeters and the annular space is about 1 millimeter high resulting in a volume for the annular space of about 0.6 cubic mm, thus the volume of the annular space is only about nineteen percent of the volume defined by the radially inward portion of the stepped bore without the portion of the valve element therein whereby at the initiation of a valve opening event, the quantity of motionless fuel in the annular space is not sufficient to cause formation of large fuel particles and at the same time the high fuel velocity from the inlets almost instantaneously generates a significant rotative motion of fuel in the annular space to generate desired fine atomization of fuel with very small average particle size.

* * * * *